United States Patent [19]

Simons et al.

[11] 4,376,465

[45] Mar. 15, 1983

[54] SPRINKLER HEAD

[75] Inventors: John R. Simons, Delavan; John W. Fenske, Wauwatosa, both of Wis.

[73] Assignee: Grunau Company Co., Milwaukee, Wis.

[21] Appl. No.: 649,928

[22] Filed: Jan. 19, 1976

Related U.S. Application Data

[63] Continuation-in-part of Ser. No. 561,982, Mar. 25, 1975, abandoned.

[51] Int. Cl.[3] ..... A62C 37/08

[52] U.S. Cl. ..... 169/39

[58] Field of Search ..... 169/37, 38, 39, 40, 169/42

[56] References Cited

U.S. PATENT DOCUMENTS

| | | | |
|---|---|---|---|
| 1,919,508 | 7/1933 | Griffith | 169/39 X |
| 2,165,477 | 7/1939 | Griffith | 169/39 |
| 2,502,754 | 4/1950 | Rowley | 169/38 |
| 3,469,632 | 9/1969 | Ault | 169/39 |
| 3,625,289 | 12/1971 | Gloeckler | 169/39 |

*Primary Examiner*—David M. Mitchell
*Assistant Examiner*—Michael Mar
*Attorney, Agent, or Firm*—Andrus, Sceales, Starke & Sawall

[57] ABSTRACT

An improved sprinkler head for an automatic fire extinguishing system. The sprinkler head comprises a frame having a discharge orifice and a deflector spaced from the orifice. A cap normally encloses the discharge orifice and is held in place by a lever assembly. The lever assembly includes a lever having a pair of spaced side flanges and a tube extends between the flanges. Located within the central portion of the tube is a fusible element and balls are positioned in the ends of the tube on either side of the fusible element and engaged with sockets in the respective flanges. In the event the element is subjected to an elevated temperature, it will melt causing the balls to move inwardly of the tube and thereby releasing the lever assembly to open the discharge orifice.

14 Claims, 9 Drawing Figures

SPRINKLER HEAD

This application is a continuation-in-part of application Ser. No. 561,982, filed Mar. 25, 1975, now abandoned.

BACKGROUND OF THE INVENTION

Sprinkler heads for an automatic fire extinguishing system normally include a low melting, fusible element having a melting point in the range of 135° F. to 600° F. In the conventional sprinkler head, the fusible element is incorporated as a component of a releasible lever assembly which acts to enclose the water discharge outlet, and when the fusible element melts at the predetermined temperature, the lever assembly is released to thereby open the discharge outlet.

In one common type of sprinkler head, the fusible element is in the form of a link that connects a pair of levers. In a sprinkler head of this kind, the fusible link is under tension stress and has a tendency to cold flow. Cold flow will cause elongation of the link thereby resulting in leakage through the sprinkler head or possible ultimate fracture of the fusible link. With this type of sprinkling head, the loading on the fusible link through use of the compression screw is critical in order to avoid undue tension stress on the loop.

Another common type of sprinkler head is one in which the fusible element is under direct compressive stress. In a sprinkler head of this type the compressive stress can cause cold flow of the fusible metal, and to reduce the tendency for cold flow, the fusible element is normally enclosed in a casing or housing. As the casing has a substantial mass, the time for the fusible element to reach its melting point is considerably increased because of the necessity of heating the mass of the casing. Therefore, the direct compressive stress type sprinkler head, in which the fusible element is contained within a casing of substantial mass, has a relative slow response time.

SUMMARY OF THE INVENTION

The invention relates to an improved sprinkler head for automatic fire extinguishing systems. The sprinkler head comprises a frame having a discharge orifice and a deflector spaced from the orifice. A gasketed cap normally encloses the discharge orifice and is held in place by a lever assembly which is connected between the cap and the frame.

The lever assembly includes a lever having a pair of spaced side flanges and a tube extends between the flanges. Located within the central portion of the tube is a fusible element, and balls are freely positioned in the ends of the tube on opposite sides of the fusible element and are engaged with sockets formed in the respective flanges.

The lever assembly also includes a normally bowed strut and the tube, which contains the fusible element, bears against the central portion of the strut. One end of the strut bears against the cap to maintain the cap in a closed position, while the opposite end of the strut is engaged with the lever at a location offset from the position of engagement of the compression screw with the lever. With this fulcrum arrangement, tightening down of the compression screw will tend to pivot the lever and cause a force to be exerted through the tube against the strut.

Either the periphery of the tube or the strut can be formed with a series of ridges or ribs which minimize the surface area contact between the members.

In the event the ambient temperature rises to the melting point of the fusible element, the element will melt and the molten metal will flow outwardly around the balls, enabling the balls to move inwardly of the tube. Inward movement of the balls reduces the frictional resistance between the balls and sockets, so that the biasing force on the lever will move the sockets out of engagement with the balls to thereby release the lever assembly and open the discharge orifice.

In a modofied form of the invention, one end of the strut is engaged with the compression screw at a location aligned with the axis of the screw, while the opposite end of the strut is engaged with a flange of the lever, which bears against the cap, at a location offset from the position of engagement of the lever flange with the cap. On melting of the fusible element and release of the lever assembly, the water pressure acting on the cap will pivot the strut about the strut end that is engaged with the compression screw and in the direction that the opposite end of the strut is offset from the axis of the cap, thereby assuring that the strut will always fall clear and will not hangup on the compression screw where it could disrupt the spray pattern of the water.

In the sprinkler head of the invention, the fusible element is not under direct compressive stress, but instead is under indirect compressive loading, thereby reducing the cold flow characteristics of the element during service. The ends of the fusible element are precompressed to form sockets to receive the balls. The precompression not only reduces the cold flow tendencies of the fusible element during service, but also acts to force the fusible material outwardly into tight bearing contact with the inner surface of the tube, thereby eliminating any air film between the members and increasing the rate of heat transfer from the tube to the fusible material.

The fusible element is retained in a thin walled tube or housing having a relatively small mass. Furthermore, the tube is exposed to the atmosphere throughout its entire periphery, and the only contact with another object is through the engagement of the external ridges with the strut, so that a better transfer of heat is achieved, thereby providing a faster rate of response.

The sprinkler head of the invention also has fewer parts than conventional sprinkler heads, making the head easier to manufacture and assemble. Further, the parts of the sprinkler head require no close manufacturing tolerances.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

The sprinkler head of the invention includes a frame 1 having a base portion 2 which is externally threaded, as indicated by 3. The base portion 2 defines a discharge outlet 4 which is in communication with the water sprinkling system.

Figure 1:
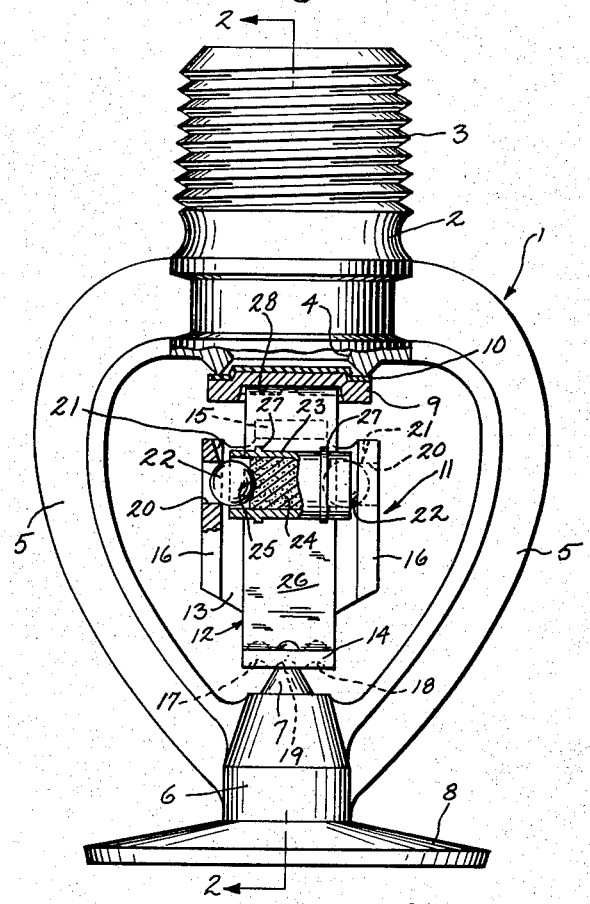
FIG. 1 is a front plan view of the sprinkler head of the invention with parts broken away in section.

As shown in FIG. 1, the frame 1 also includes a pair of curved arms 5 connected to a hub 6, which has a threaded bore to receive a conventional compression screw 7. A deflector plate 8 is mounted on the hub 6.

The discharge outlet 4 is normally enclosed by a cap 9 and gasket 10, and the cap is held in place by a lever assembly indicated generally by 11.

Figure 5:
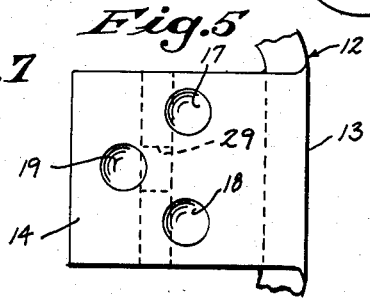
FIG. 5 is a section taken along line 5—5 of FIG. 2.
Figure 6:
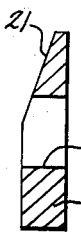
FIG. 6 is a section taken along line 6—6 of FIG. 2.

According to the invention, the lever assembly 11 includes a lever 12 composed of a body portion 13, a lower flange 14, an upper flange 15, and a pair of spaced side flanges 16, or arms. The lower flange 14, as shown in FIG. 5, is provided with three depressions or dimples 17, 18 and 19 and the pointed tip of the compression screw 7 is received within the dimple 19.

As illustrated in FIG. 1, the inner surfaces of the side flanges 16 are provided with openings or sockets 20, and an inclined ramp 21 connects each of the sockets 20 with the upper edge of the respective side flange 16. While the sockets 20 are shown as being formed by holes that extend through the flanges 16, it is contemplated that the sockets can be provided by milling shallow curved recesses in the inner surface of the flanges.

The sockets 20 are adapted to receive balls 22 which are located in the ends of a tube or housing 23. Positioned within the central portion of the tube 23, between the balls 22, is a fusible element 24, formed of a low melting point alloy, such as solder, having a known fusing or melting temperature. The ends of the element 24 are provided with recesses or sockets 25 which receive the balls 22. The balls 22 have a diameter slighly less than the internal diameter of the tube so that the element 24, when melted, can flow outwardly around the balls.

The fusible element is precompressed to form the sockets 25. In the pre-compressing operation, the element 24 and balls 22 are placed in the tube 23, and while the tube is held in an outer die or clamp, a compressive force is applied to the balls, thereby forming the sockets 25 and causing the alloy to flow radially outward into tight engagement with the inner surface of the tube and longitudinally outward to partially surround the balls. The pre-compression thus provides a multiple function in that it not only compresses the alloy to minimize cold flow during service, but forms the sockets and provides a tight bearing engagement between the fusible alloy and the tube to increase the rate of heat transfer to the alloy.

The ramps 21, which are connected between the upper edges of the side flanges and the sockets 20, facilitate the installation of the balls 22 and tube 23 between the side flanges 16. The tube 23, containing the fusible element 24 and the balls 22, is positioned between the side flanges 16 and the balls 22 are moved up the respective ramps 21, thereby deflecting the side flanges 16 outwardly by a wedging type of action, until the balls 22 snap into place in the sockets 20. The use of the ramps 21 prevents undue deflection of the side flanges 16 and prevents deflection of the side flanges beyond the elastic limit of the metal.

The lever assembly 11 also includes a bowed strut or second lever member 26 which is interposed between the lower flange 14 of lever 12 and the cap 9. The tube 23 is provided with a pair of circumferential ridges or ribs 27, and the central portion of the strut 26 bears against the ridges. The ridges 27 minimize the area of contact between the strut 26 and the tube 23 and provide for air flow around the entire periphery of the tube, thereby increasing the rate of heat transfer to the fusible element 24.

Figure 4:
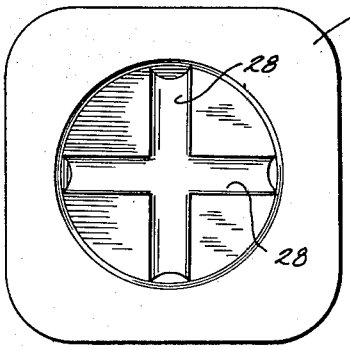
FIG. 4 is a transverse section taken along line 4—4 of FIG. 2.

As best shown in FIG. 4, the lower surface of the cap 9 is provided with a pair of intersecting grooves 28, and the upper end of the strut 26 is received in one of the grooves 28. As the cap 9 has a square periphery and has two intersecting grooves 28. Orientation of the cap during assembly is facilitated.

Figure 2:
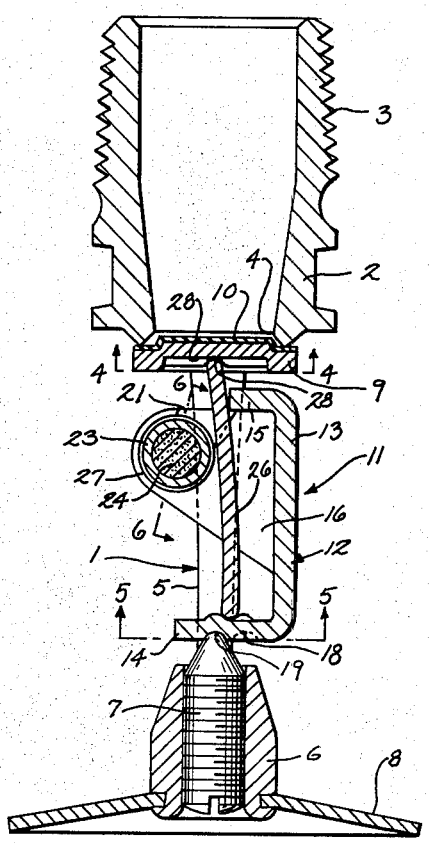
FIG. 2 is a section taken along line 2—2 of FIG. 1.

As shown in FIGS. 2 and 5, the lower end of the strut 26 is received between the dimples 17 and 18 and 19 on flanges 14 of the lever and the lower end of the strut is provided with a notch 29 which engages dimple 19 to thereby prevent movement of the strut in a direction parallel to the axis of the tube 23.

As shown in FIGS. 2 and 5, the tip of compression screw 7 is engaged with dimple 19, and is thus offset from the position of engagement of the end of the strut 26 with flange 14, which constitutes a fulcrum.

The strut 26 is formed with a natural bow, and when the compression screw 7 is turned down, the lever will tend to pivot about the fulcrum (to the right as shown in FIG. 2) and urge the tube 23 against the central portion of the strut tending to further bow or deform the strut, and this biasing force is resisted by the frictional engagement of balls 22 with sockets 20. The sockets 20 are preferably designed so that no more than one-quarter of the circumference of the ball is in the socket, in order to provide the desired release action.

Figure 3:
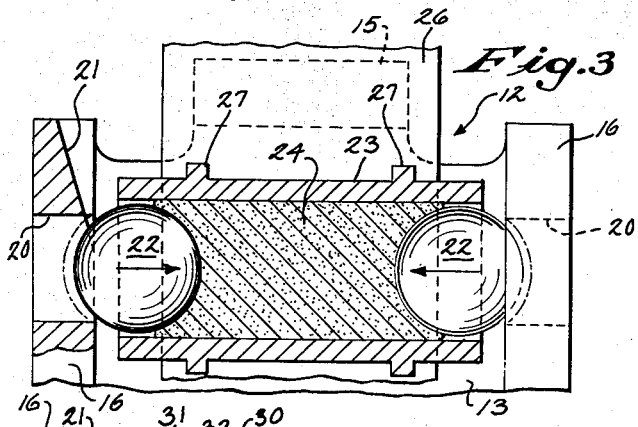
FIG. 3 is an enlarged fragmentary section of a portion of the lever assembly and showing the fusible element in the melted condition just prior to release of the lever assembly.

In the event the ambient temperature increases to a point sufficiently high to melt the fusible element 24, the molten material will flow into the areas between the ball and the inner surface of the tube, as shown in FIG. 3, and the biasing force exerted by the lever 12 will wedge the balls inwardly of the tube 23. When the balls have been moved inwardly to a predetermined position, the biasing force exerted by the lever against the strut 26 will be sufficient to overcome the frictional resistance of the balls 22 in the sockets 20, thereby releasing the lever assembly and permitting the water to be discharged through the outlet 4.

As the fusible element 24 is not subjected to direct compressive loading, there is less tendency for cold flow in the fusible material. As the screw 7 is turned down, the force exerted by the tube 23 against the strut 26 will be increased. However, the force is not a direct compressive loading against the fusible element, so there is less tendency for cold flow of the element under operating stress. Thus, the loading on the lever assembly through the compression screw is less critical than in conventional sprinkler heads.

The sprinkler head of the invention also has improved response due to the fact that the mass of the thin walled tube 23, is relatively small. Due to the ribs 27, air can circulate around the entire periphery of the tube. This not only increases the heat transfer to the fusible element, but by minimizing contact between the tube and the strut, decreases the tendency of the other components of the lever assembly to serve as a heat sink. Because of these factors the response rate of the element is vastly improved.

As the fusible element is precompressed to form the sockets 25, there is less tendency for the fusible element to flow under operating stress conditions. This insures that the lever assembly will be retained in the desired stressed condition, and prevents leakage through the sprinkler head. Precompression also provides a firm bond between the fusible element and the tube, eliminating any air film between the members, and thereby increases the rate of heat transfer to the element.

Figure 7:
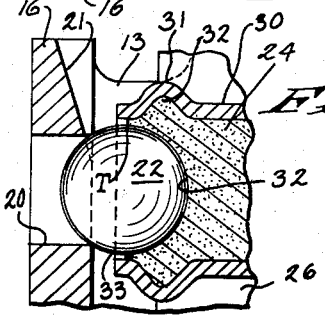
FIG. 7 is a modified form of the invention showing a fragmentary section of a portion of the lever assembly.

FIG. 7 illustrates a modified form of the invention having a variation in the construction of the tube which houses the balls and fusible element. As shown in FIG. 7, the fusible element 24 and balls 22 are disposed within tube 30, and the balls 22 are engaged with sockets 20 in the flanges 16 of the lever 12 as described in the first embodiment.

The tube 30 is formed with a pair of outwardly extending circumferential ribs 31 and define internal grooves 32. As in the case of the first embodiment, the ribs 31 are adapted to bear against the strut 26.

The balls 22 are positioned within the sockets 32 formed in the ends of the element 24, and as shown in FIG. 7, the fusible material is located within the grooves 32 and extends partially around the balls so that the balls are separated from the inner surface of the tube by a thin layer of the fusible material indicated by 33.

The ribs 31 and corresponding grooves are preferably formed during the precompression operation, in which the balls and fusible element are placed in the thin walled tube 30, and the tube is positioned in a clamping die having a pair of circumferential gaps or interruptions corresponding to the ultimate location of the ribs 31. When a compressive force is applied to the balls 22, the thin walled tube will be deformed outwardly into the gaps in the die to form the ribs 31 and the fusible material will be forced outwardly into the resulting grooves as well as axially outwardly around the balls. As shown in FIG. 7, the outer edge of each groove 32 is located immediately inward, in an axial direction, of the line of tangency T of the ball 22 and the tube 23.

When the sprinkler head is exposed to an elevated temperature in an emergency condition, the fusible element will melt and the ball 22 will be urged inwardly of the tube as previously described. During the initial inward movement of the balls, the molten alloy will flow outwardly through the narrow space between the balls and the internal surface of the tube. However, when the balls 22 have moved inwardly to a position where the line of tangency T registers with the groove 32, the space between the periphery of the ball and the inner surface of the tube will be increased, thereby permitting a faster rate of outward flow of the molten alloy, and thereby increasing the response rate of the sprinkler head. Thus, the construction of FIG. 7, provides a close fit between the balls 22 and the tube 23 during normal service to prevent foreign material from entering the tube, and automatically increases the clearance between the members on melting of the fusible element to increase the response time.

Figure 8:
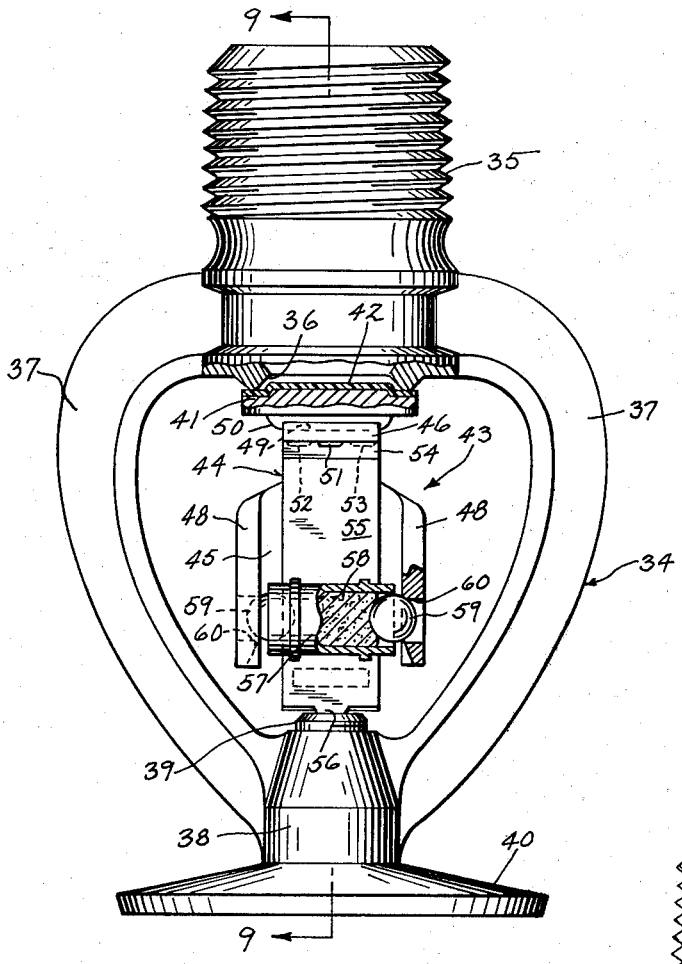
FIG. 8 is a front plan view of a modified form of the sprinkler head with parts broken away in section.
Figure 9:
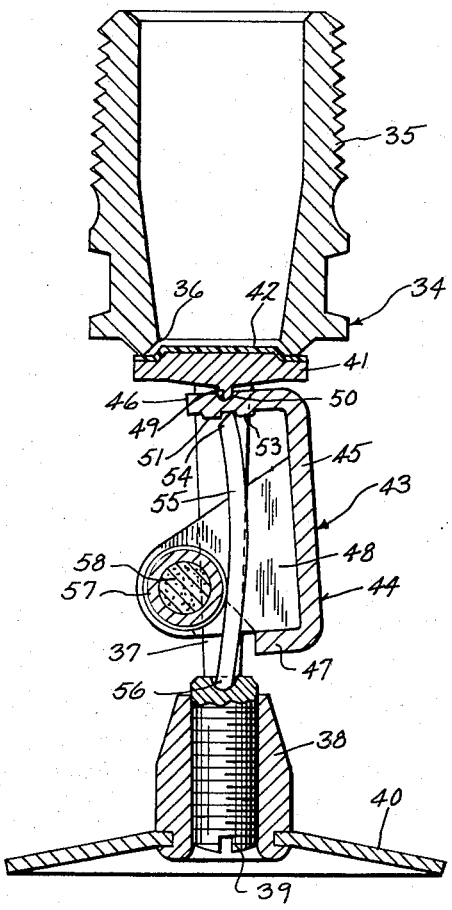
FIG. 9 is a section taken along line 9—9 of FIG. 8.

FIGS. 8 and 9 illustrate a modified form of the sprinkler head of the invention. The sprinkler head includes a frame 34 having an externally threaded base portion 35 that defines a discharge outlet 36, which is in communication with the water sprinkling system.

The frame 34 also is provided with a pair of curved arms 37 which connect the base 35 with a hub 38, and the hub has a threaded base to receive a compression screw 39. A conventional deflector disc or plate 40 is mounted on hub 38.

The discharge outlet 36 is normally enclosed by a cap 41 and gasket 42, and the cap is retained in position by a lever assembly 43.

In the embodiment shown in FIGS. 8 and 9, the lever assembly 43 includes a lever 44, similar in construction to lever 12 of the first embodiment, and composed of a body portion 45, a a flange 46, a flange 47 and a pair of spaced arms 48. The outer surface of flange 46 is provided with a groove 49 that engages a ridge 50 on cap 41, while the inner surface of flange 46 is formed with three projections 51, 52 and 53, and the end 54 of a deformable strut or second lever member 55 is retained between the projections, with the projection 51 being located on one side of the strut end 54 and the projections 52 and 53 being positioned on the opposite side of the strut end.

The other end of the strut 55 is provided with a projection or ear 56 that is received in a slot in the end of compression screw 39.

As in the case of the embodiment of FIGS. 1 and 2, a tube 57 containing a fusible element 58, such as solder, extends between the arms 48 of the lever 44, and balls 59, are located within the ends of the tube 57 and are received within sockets 60 in the respective arms 48. The construction of the arms 48, sockets 60, tube 57 and balls 59 is similar to that previously described with respect to the embodiment of FIGS. 1 and 2.

As shown in FIG. 9, the end 56 of the strut 55 is aligned with the axis of the compression screw 39, while the opposite end 54 of the strut is offset from the position of engagement of the lever flange 46 and the cap 41, thus constituting a fulcrum. When the compression screw 39 is turned down, the lever 44 will tend to pivot about the fulcrum and urge the tube 57 against the central portion of strut 55 tending to further bow or deform the strut. This biasing force is resisted by the frictional engagement of the balls 59 with sockets 60.

When the sprinkler head is exposed to an elevated temperature sufficiently high to meet the fusible element 58, the biasing force exerted by lever 44 will wedge the balls 59 inwardly of the tube 57, as previously described, thereby releasing the lever assembly. The water pressure will displace the cap 41 and the water will flow from the outlet 36. As the end 54 of the strut 55 is offset from the center or axis of the cap, the water pressure acting on the cap on release of the lever assembly, will pivot the strut 55 to the right, as viewed in FIG. 9, about the strut end 56, thereby assuring that the strut will fall clear and will not hang up on the compression screw 39 where it could disrupt the spray pattern of the water. The cap 41 will move with the lever 44 on release of the lever assembly due to the engagement of strut end 54 with projections 51-53, and this lateral movement of the cap will prevent the cap from hanging up on the compression screw where it could disrupt the water spray pattern.

While the above description has shown the deflector 8 located below the discharge outlet 4, it is contemplated that the construction of the invention can also be utilized in sprinkler heads in which the deflector is located above or to the side of the discharge outlet.

Similarly, while the drawings have shown the use of balls 22, other movable members of various configurations can be employed.

Various modes of carrying out the invention are contemplated as being within the scope of the following claims particularly pointing out and distinctly claiming the subject matter which is regarded as the invention.

We claim:

1. In a sprinkler having a frame with first and second ends, an orifice for discharging fluid at the first end of the frame, and a cap over the orifice for normally preventing discharge of fluid from the orifice, a structure positioned between the cap and the second end of the frame for releasably retaining the cap over the orifice, which structure comprises:

a first member engaging the cap, a second member engaging the second end of the frame, the first and second members being pivotally engaged and having adjacent portions tending to move away from each other in response to compressive force applied to the structure between the cap and the second end of the frame, a pair of arms affixed to and extending in spaced relation away from one of the first and second members in the direction of the other of the first and second members and straddling the adjacent portion of the other of the first and second members, a tubular retainer normally held between the pair of arms and engaging the straddled member, eutectic means within the tubular retainer, and arm-engaging means projecting from the tubular retainer and normally engaging one of the pair of arms to normally hold the tubular retainer in position to engage the straddled member but responsive to melting of the eutectic means to move inwardly in the tubular retainer, permitting the retainer to be released from the pair of arms and allowing the straddled member to move away from the adjacent portion of the other member and release the cap from its position over the orifice.

2. A fire extinguishing sprinkler head, comprising a frame having a discharge outlet and a deflector spaced relative to the outlet, a compression screw mounted for movement with respect to the frame and located adjacent the deflector and axially aligned with said discharge outlet, a cap normally enclosing said discharge outlet, a releasable lever assembly positioned between the frame and the cap, said lever assembly including a first member comprising a lever having a pair of spaced arms, a hollow member extending in a direction between said arms, a fusible element disposed in said hollow member, a ball located in one end of the hollow member outwardly of said fusible element, socket means formed in one of said arms, said ball being engaged with said socket means, said hollow member being formed with an internal recess disposed axially inward of said ball, said lever assembly also including a second member comprising a lever disposed in engagement with the peripheral surface of said hollow member, said lever assembly extending between said cap and said compression screw and acting to hold the cap in a closed position, turning down of said compression screw causing a biasing force to be exerted in a direction to effect disengagement of said ball with said socket means, the biasing force being resisted by the frictional engagement of the ball with said socket means to retain the lever assembly in a locked condition, melting of said fusible element acting to reduce the frictional resistance between the ball and said socket means to thereby enable the force of said biasing means to overcome said frictional resistance and release said lever assembly to open said discharge outlet.

3. The sprinkler head of claim 2, wherein said fusible element is disposed within said internal recess.

4. The sprinkler head of claim 3, wherein said hollow member is a cylindrical tube and said internal recess is a circumferential groove disposed immediately adjacent the line of tangency of the ball and the inner surface of the hollow member.

5. A fire extinguishing sprinkler head, comprising a frame having a discharge outlet and a deflector spaced relative to the outlet, a compression screw mounted for movement with respect to the frame and located adjacent the deflector and axially aligned with said discharge outlet, a cap normally enclosing said discharge outlet, a releasible lever assembly positioned between the screw and the cap, said lever assembly including a pair of members, a first of said members comprising a lever having a body and having a pair of spaced generally parallel arms extending outwardly from the body, a tube extending in a direction between said arms, a fusible element disposed in said tube, a movable member having a generally curved outer portion projecting outwardly of an end of said tube and having an inner portion bearing against the fusible element, generally circular socket means in one of said arms and spaced from the peripheral edge of the arm and axially aligned with said tube, the outer portion of said movable member being engaged with said socket means, the second of said pair of members being disposed in engagement with the outer peripheral surface of said tube, one end of the second member being engaged with the compression screw and an end portion of said first member being engaged with said cap, the opposite end of the second member being engaged with said end portion of the first member at a location offset from the location of engagement of said end portion and the cap.

6. The sprinkler head of claim 5, wherein the engagement of the second member with the compression screw is in axial alignment with the position of engagement of said end portion with said cap.

7. The sprinkler head of claim 5, wherein said end portion comprises a flange extending outwardly from said body.

8. The sprinkler head of claim 5, wherein a movable member is disposed in each end of the tube on opposite sides of the fusible element and each arm has socket means to receive the respective movable member.

9. The sprinkler head of claim 8, wherein the movable members are balls.

10. A fire extinguishing sprinkler head, comprising a frame having a discharge outlet and a deflector spaced relative to the outlet, a cap normally enclosing the discharge outlet, a releasable lever assembly positioned between the frame and the cap, said lever assembly including a lever member having a pair of spaced sections, a hollow member extending in a direction between said sections, socket means in at least one of said sections and disposed in axial alignment with said hollow member, a fusible element disposed in said hollow member, a movable member located in at least one end of the hollow member and bearing between the end of the fusible element and the socket means, said lever assembly also including a strut member disposed in engagement with the peripheral surface of the hollow member and exerting a force in a direction to disengage the movable member from the socket means, the frictional engagement of said movable member with the socket means resisting said force, one of said hollow member and said strut member being provided with a projection, said projection being disposed in engagement with the other of said hollow member and said strut member, melting of said fusible element causing said movable member to move inwardly of said hollow member, whereby enabling the force of said strut member to overcome the frictional engagement of the movable member with said socket means to release the lever assembly said open said cap from the discharge outlet.

11. The sprinkler head of claim 10, wherein the hollow member is provided with at least one circumferential projection and the strut member is engaged with the projection.

12. A fire extinguishing sprinkler head, comprising a frame having a discharge outlet and a deflector spaced relative to the outlet, a compression screw mounted for movement with respect to the frame and located adjacent the deflector and axially aligned with said discharge outlet, a cap normally enclosing said discharge outlet, a releasable lever assembly positioned between the screw and the cap, said lever assembly including a first lever member having a pair of spaced arms, a hollow member extending in a direction between said arms, a fusible element disposed in said hollow member, a ball located in one end of the hollow member outwardly of said fusible element, socket means formed in a first of said arms, said ball being engaged with said socket means, said socket means being spaced from the peripheral edge of said first arm, said first arm having an inclined surface interconnecting said peripheral edge and said socket means, whereby the ball can be moved up the inclined surface into engagement with said socket means on installation of said lever assembly, said lever assembly also including a second lever member bearing against the peripheral surface of said hollow member, said lever assembly extending between said cap and said compression screw and acting to hold the cap in a closed position, turning down of said compression screw causing a biasing force to be exerted in a direction to effect disengagement of said ball with said socket means, the biasing force being resisted by the frictional engagement of the ball with said socket means to retain the lever assembly in a locked condition, melting of said fusible element acting to reduce the frictional resistance between the ball and said socket means to thereby enable the force of said biasing means to overcome said frictional resistance and release said lever assembly to open said discharge outlet.

13. The sprinkler head of claim 12, wherein said socket means comprises a hole in said first arm, said ball being engaged with the annular edge of the arm bordering the hole to provide a substantial line contact between the ball and the arm.

14. The sprinkler head of claim 12, wherein the end of the fusible element has a pocket to receive said ball, and the diameter of the ball is slightly less than the internal diameter of the hollow member.

* * * * *

UNITED STATES PATENT AND TRADEMARK OFFICE

CERTIFICATE OF CORRECTION

PATENT NO. : 4,376,465

DATED : March 15, 1983

INVENTOR(S) : JOHN R. SIMONS ET AL

It is certified that error appears in the above-identified patent and that said Letters Patent is hereby corrected as shown below:

At [75] of Cover Page, Delete "JOHN R. SIMONS, Delavan"; Delete "both"; Col. 3, line 44, Cancel "slighly" and substitute therefor ---slightly---, Col. 9, line 11, CLAIM 10, Cancel "whereby" and substitute therefor ---thereby---.

Signed and Sealed this

*Third* Day of *April 1984*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,376,465

DATED : March 15, 1983

INVENTOR(S) : JOHN W. FENSKE

It is certified that error appears in the above-identified patent and that said Letters Patent are hereby corrected as shown below:

At [73] Assignee: "GRUNAU COMPANY CO." should read

---GRUNAU COMPANY INC.---

Signed and Sealed this

*Twelfth* Day of *June 1984*

[SEAL]

*Attest:*

GERALD J. MOSSINGHOFF

*Attesting Officer*

*Commissioner of Patents and Trademarks*